US011118588B2

(12) United States Patent
Schlittler et al.

(10) Patent No.: US 11,118,588 B2
(45) Date of Patent: Sep. 14, 2021

(54) DUAL PUMP SYSTEM

(71) Applicant: Cornell Pump Company, Clackamas, OR (US)

(72) Inventors: William Schlittler, Colorado Springs, CO (US); James Garvin, Milwaukie, OR (US); Andrew Enterline, Troutdale, OR (US)

(73) Assignee: Cornell Pump Company, Clackamas, OR (US)

( * ) Notice: Subject to any disclaimer, the term of this patent is extended or adjusted under 35 U.S.C. 154(b) by 502 days.

(21) Appl. No.: 16/021,331

(22) Filed: Jun. 28, 2018

(65) Prior Publication Data

US 2019/0063441 A1 Feb. 28, 2019

Related U.S. Application Data

(60) Provisional application No. 62/551,325, filed on Aug. 29, 2017.

(51) Int. Cl.

| | |
|---|---|
| ***F04D 15/00*** | (2006.01) |
| ***F04D 13/14*** | (2006.01) |
| ***F04D 13/02*** | (2006.01) |

(52) U.S. Cl.

CPC ..... *F04D 15/0072* (2013.01); *F04D 13/02* (2013.01); *F04D 13/14* (2013.01); *F04D 15/0005* (2013.01)

(58) Field of Classification Search

CPC .... F04D 1/10; F04D 15/0005; F04D 15/0072; F04D 13/02; F04D 13/06; F04D 13/12; F04D 13/14; F04D 17/12; F04D 17/14; F04D 25/02; F04D 25/06; F04D 25/0606

USPC ..... 417/62

See application file for complete search history.

(56) References Cited

U.S. PATENT DOCUMENTS

| | | | | | |
|---|---|---|---|---|---|
| 1,049,894 | A * | 1/1913 | Merrill | F04B 49/007 | 417/62 |
| 2,166,836 | A * | 7/1939 | Davis | F04B 15/02 | 417/62 |
| 2,207,220 | A * | 7/1940 | Hollander | F04D 1/10 | 415/61 |
| 2,218,565 | A * | 10/1940 | Vickers | F04B 49/007 | 417/62 |
| 2,900,918 | A | 8/1959 | Thomas et al. | | |
| 4,077,743 | A * | 3/1978 | Cochrane | F04B 41/06 | 417/243 |
| 4,932,837 | A * | 6/1990 | Rymal | F04D 7/04 | 415/169.1 |

(Continued)

FOREIGN PATENT DOCUMENTS

| | | | |
|---|---|---|---|
| CN | 87213415 | U | 8/1988 |
| CN | 101440815 | A | 5/2009 |

(Continued)

*Primary Examiner* — Dominick L Plakkoottam
*Assistant Examiner* — Charles W Nichols
(74) *Attorney, Agent, or Firm* — Snyder, Clark, Lesch & Chung, LLP

(57) ABSTRACT

A pump system includes dual centrifugal pumps mounted on a fabricated skid. Both pumps are belt driven by one motor. The pumps are piped with three two-way valves and cross-over piping configured such that the pumps can be operated in either series or parallel flow using a single inlet and outlet for the system.

8 Claims, 6 Drawing Sheets

PARALLEL OPERATION

SERIES OPERATION

(56) References Cited

U.S. PATENT DOCUMENTS

| | | | | |
|---|---|---|---|---|
| 5,135,361 | A * | 8/1992 | Dion | F04D 15/0072 417/2 |
| 5,431,545 | A | 7/1995 | Knight et al. | |
| 5,941,786 | A | 8/1999 | Van Wijk et al. | |
| 6,447,262 | B1 | 9/2002 | Clements | |
| 7,010,393 | B2 | 3/2006 | Mirsky et al. | |
| 2004/0134486 | A1 * | 7/2004 | Robert | A61M 1/1068 128/200.13 |
| 2007/0189905 | A1 | 8/2007 | Dinsdale et al. | |
| 2013/0164149 | A1 * | 6/2013 | Mehr | F04B 23/04 417/62 |
| 2015/0148972 | A1 | 5/2015 | Blaumann et al. | |
| 2017/0030359 | A1 | 2/2017 | Fowler et al. | |

FOREIGN PATENT DOCUMENTS

| | | | |
|---|---|---|---|
| CN | 203906317 | U | 10/2014 |
| CN | 104533797 | A | 4/2015 |
| CN | 204572469 | U | 8/2015 |
| CN | 104895802 | A | 9/2015 |
| CN | 204716559 | U | 10/2015 |
| CN | 103899542 | B | 4/2016 |
| EP | 877165 | A2 | 11/1998 |

* cited by examiner

DUAL PUMP SYSTEM

CROSS-REFERENCE TO RELATED APPLICATION

This application claims priority under 35 U.S.C. § 119 based on U.S. Provisional Application No. 62/551,325 filed Aug. 29, 2017, the contents of which are hereby incorporated herein by reference in their entirety.

FIELD OF THE INVENTION

The disclosed invention relates to a centrifugal pump system, and more particularly a centrifugal pump system for sand and aggregate applications.

BACKGROUND OF THE INVENTION

In aggregate plants, or sand and gravel plants, filter feed systems separate fine solids from liquid by pumping slurry through filter screens. During initial stages, higher slurry volumes are required for better efficiency. As the filter screens fill up with solids, higher pressure is needed to pass fluids through the filter.

A two-stage pump has been used in an attempt to meet the changing volume and pressure requirements for filter feed applications. To meet these demands, the two-stage pump is forced to run outside of the recommended performance range. Operating the two-stage pump outside the recommended performance range results in overall reduced pump life, including low bearing life, increased wear due to solids, and high vibration.

SUMMARY OF THE INVENTION

In one aspect of the invention, a dual pump system may be selectively configured to operate in parallel or in series. The dual pump system includes a first pump; a second pump; a motor simultaneously driving the first and second pumps; suction piping with a first branch leading to the first pump and a second branch leading to the second pump; first discharge piping connecting the first pump to a discharge port; second discharge piping connecting the second pump to the discharge port; crossover piping connecting the first discharge piping to the second branch suction piping; a first two-way valve installed in the second branch; a second two-way valve installed in the first discharge piping and downstream of the crossover piping; and a third two-way valve installed in the crossover piping. The first pump and the second pump operate in parallel when the first and second two-way valves are opened and the third two-way valve is closed. The first pump and the second pump operate in series when the first and second two-way valves are closed and the third two-way valve is opened.

In aspect of the invention, a method is performed by a dual pump system that includes a first pump, a second pump, a motor simultaneously driving the first and second pumps, suction piping with a first branch leading to the first pump and a second branch leading to the second pump, first discharge piping connecting the first pump to a discharge port, second discharge piping connecting the second pump to the discharge port, and crossover piping connecting the first discharge piping to the second branch. The method includes opening a first two-way valve installed in the second branch to allow fluid flow through the second branch; opening a second two-way valve installed in the first discharge piping and downstream of the crossover piping to allow fluid flow through the first discharge piping from the first pump to the discharge port; closing a third two-way valve installed in the crossover piping to prevent fluid flow through the crossover piping, operating the first pump and the second pump simultaneously to generate parallel fluid flow through the first pump and the second pump; detecting completion of a preset time interval; closing, in response to the detecting, the first two-way valve to prevent fluid flow in the second branch upstream of an intersection with the crossover piping; closing, in response to the detecting, the second two-way valve to prevent fluid flow in the first discharge piping between another intersection with the crossover piping and the discharge port; opening, in response to the detecting, the third two-way valve to allow fluid flow through the crossover piping; and continuing, after the detecting, to operate the first pump and the second pump simultaneously so the dual pump system generates additional fluid pressure in series through the dual pump system.

DETAILED DESCRIPTION OF THE PREFERRED EMBODIMENTS

The following detailed description refers to the accompanying drawings. The same reference numbers in different drawings may identify the same or similar elements. Also, the following detailed description does not limit the invention.

According to an implementation described herein, a centrifugal pump system includes dual centrifugal pumps mounted on a fabricated skid. Both pumps are belt driven by one motor. The pumps are piped and with two-way valve configurations such that the pumps can run in series or parallel operation.

In filter feed applications, when initially filling the filter, the flow requirement is high and pressure requirement is low. The two pumps in the centrifugal pump system can run in parallel to achieve high flow. As filter fills up with solids, the flow requirement reduces and the pressure requirement increases. The two pumps can be automatically switched to series operation to meet the higher pressure requirements.

In the above higher-flow or higher-pressure conditions (and all other conditions of the filter feed applications), both pumps can always run in the allowable operating region of the pump curve. Thus, the overall life of the pumps will be greater than, for example, the existing two-stage pump systems.

Figure 1:
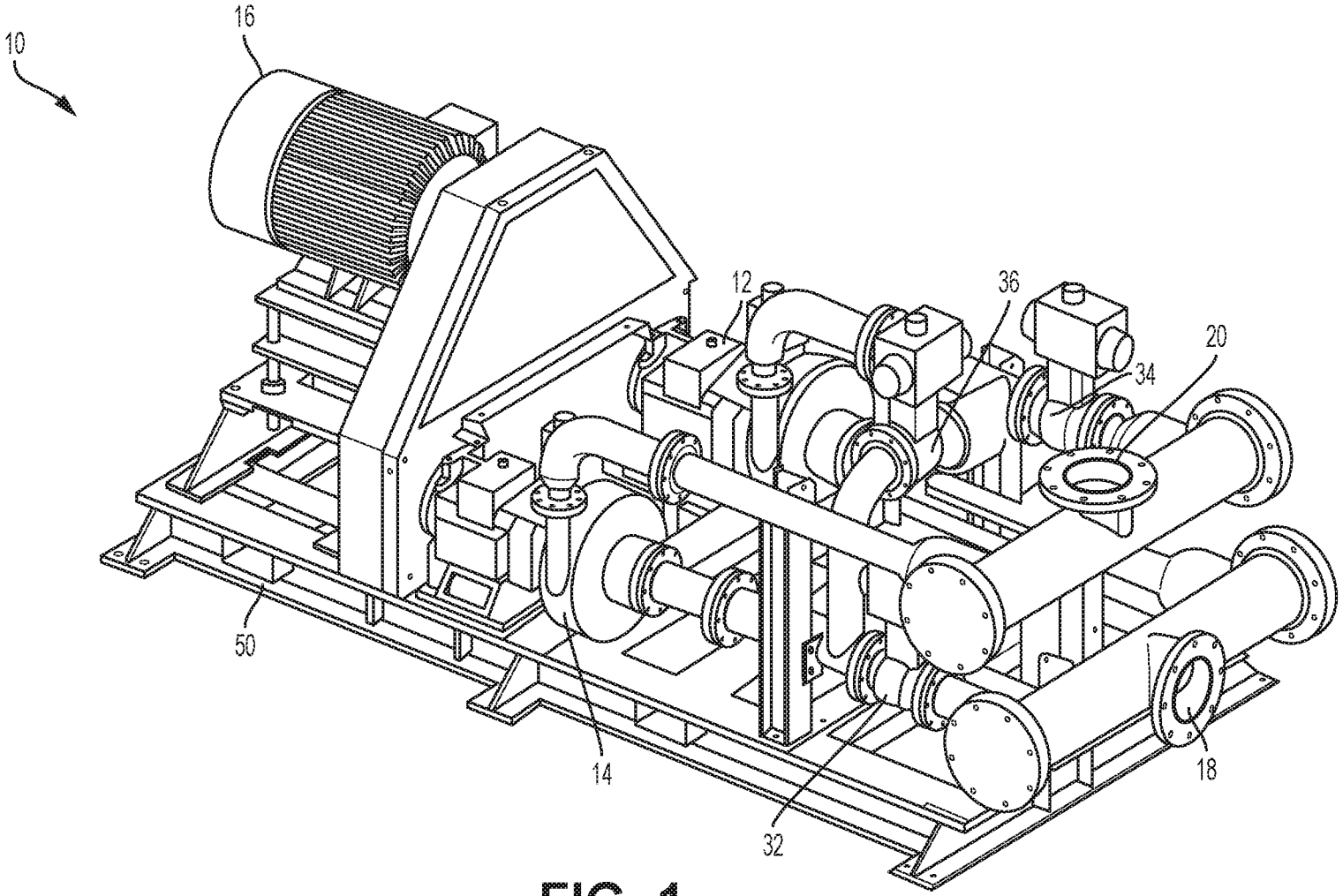
FIG. 1 is an isometric view of an exemplary embodiment of a dual pump system, according to an implementation described herein.
Figure 2A:
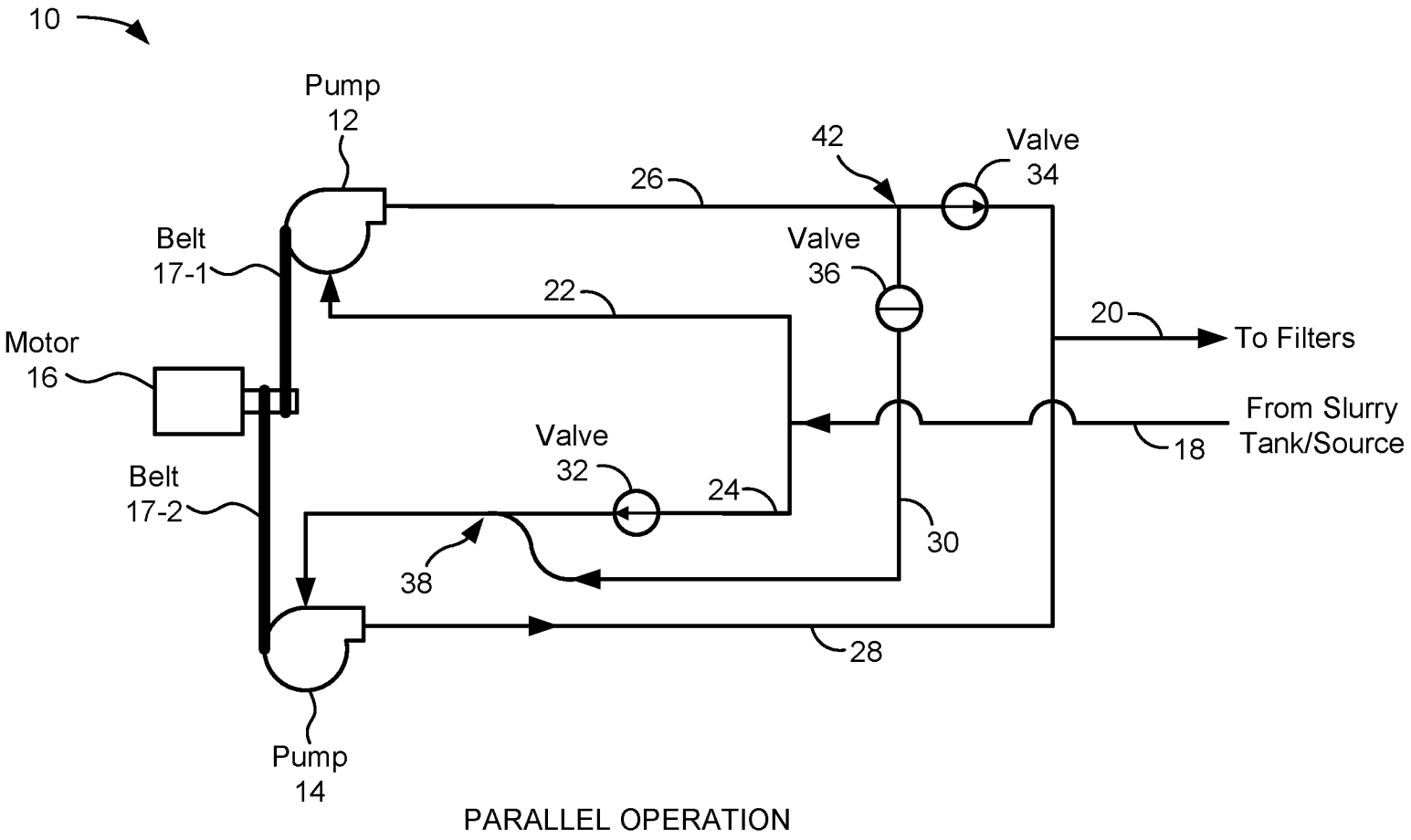
FIG. 2A is schematic of the dual pump system of FIG. 1 showing the system in a parallel flow configuration.

FIG. 1 is an isometric view of an exemplary embodiment of a dual pump system 10, according to an implementation described herein. FIG. 2A is schematic of dual pump system 10 in a parallel flow configuration, and FIG. 2B is schematic of dual pump system 10 in a series flow configuration.

Figure 2B:
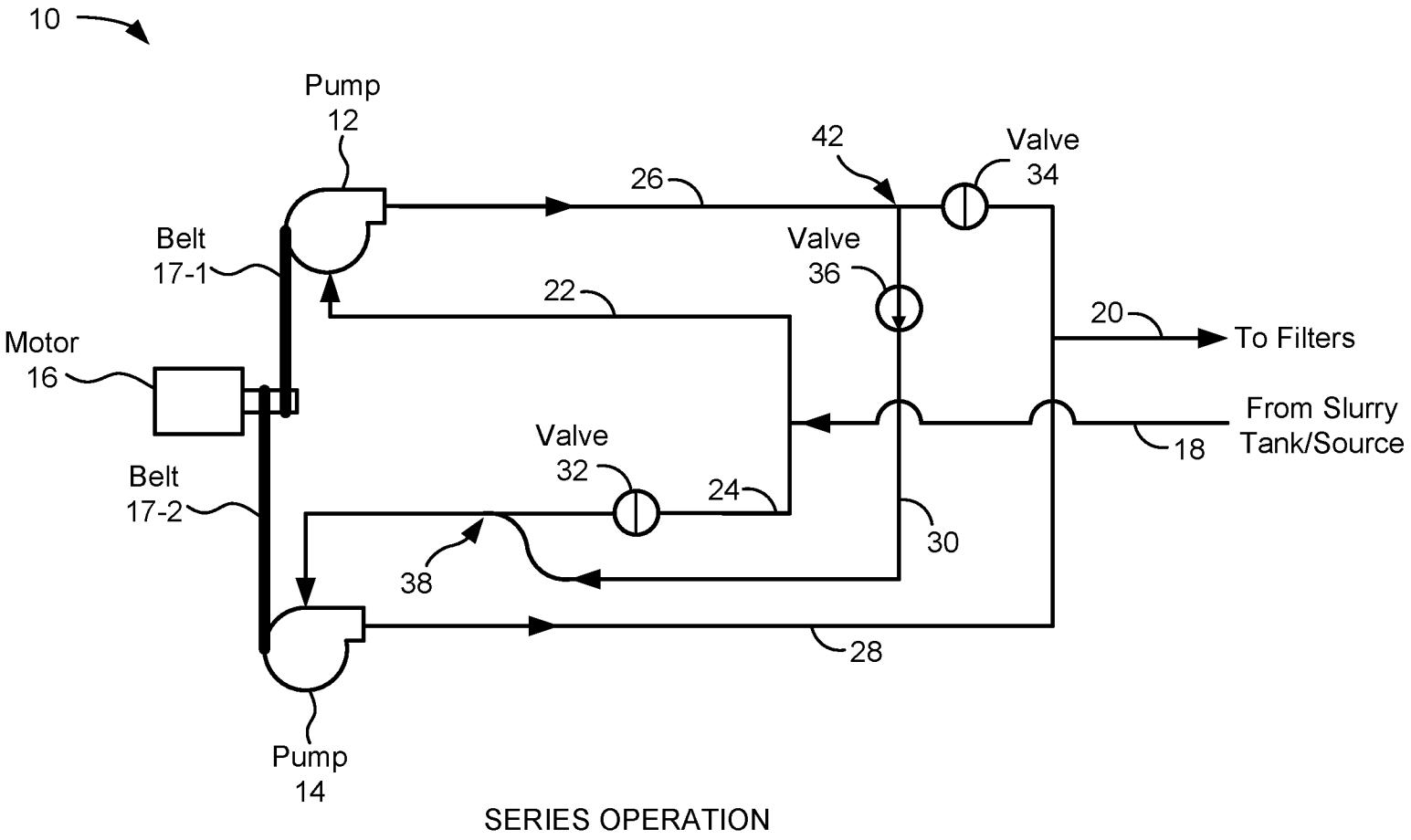
FIG. 2B is schematic of the dual pump system of FIG. 1 showing the system in a series flow configuration.

Referring collectively to FIGS. 1-2B, dual pump system 10 may include a pair of centrifugal pumps 12 and 14 driven by a single motor 16. In one implementation, pumps 12 and 14 may have identical characteristics (such as capacities, size, etc.). Motor 16 may include, for example, a variable speed electric motor. Motor 16 may use belts 17-1 and 17-2 to simultaneously drive pumps 12 and 14. Thus, according to one implementation, pumps 12 and 14 will have identical operating levels (or output) during any stage of operation.

Pumps 12 and 14 may be fluidly connected by piping to a single inlet 18 and a single outlet 20 (also referred to as a discharge port). Inlet 18 may connect to and draw material from a feed port, such as a feed port for a slurry tank, etc. Outlet 20 may connect to and discharge material toward a set of screens or filters. Inlet 18 connects to suction piping with branches 22 and 24. Branch 22 may lead to pump 12, and branch 24 may lead to pump 14. Discharge piping 26 connects pump 12 to outlet 20, and discharge piping 28 connects pump 14 to outlet 20. Crossover piping 30 connects discharge piping 26 to branch 24.

According to an implementation, pumps 12 and 14 each may have a maximum flow operating level of 520 gallons-per-minute (gpm). Pumps 12 and 14 may be configured with lower or higher maximum flow levels in other implementations. In one implementation, pumps 12 and 14 may be rated for use with a slurry having a solids diameter of up to 0.5 inches, although larger solids diameters may be used in other configurations. According to another implementation, branches 22 and 24 may have at least three inch diameter piping, while discharge piping 26 and 28 may be at least two inch diameter.

Three two-way valves 32, 34, and 36 are installed in dual pump system 10 to selectively change the fluid flow for supporting parallel or series operation of pumps 12 and 14. According to an implementation, each of valves 32, 34, and 36 may be controlled by an actuator (see FIG. 3) to automatically change a valve position between an open position and a closed position. As shown in FIGS. 2A and 2B, valve 32 is located along branch 24, between inlet 18 and a junction 38 of crossover piping 30 and branch 24. Thus, valve 32 is upstream of junction 38. Valve 34 is located along discharge piping 26 between outlet 20 and a junction 42 of crossover piping 30 and discharge piping 26. Thus, valve 34 is downstream of junction 42. Valve 36 may be located anywhere along the length of crossover piping 30.

Dual pump system 10 operates pumps 12 and 14 in parallel when valves 32 and 34 are in the open position and valve 36 is in the closed position, as shown in FIG. 2A. More particularly, fluid from inlet 18 passes through both branches 22 and 24 to respective pumps 12 and 14. Discharge from pump 12 flows through discharge piping 26 to outlet 20, while discharge from pump 14 flows through discharge piping 28 to outlet 20. The closed position of valve 36 prevents fluid flow across crossover piping 30.

Dual pump system 10 operates pumps 12 and 14 in series when valves 32 and 34 are in the closed position and valve 36 is in the open position, as shown in FIG. 2B. More particularly, fluid from inlet 18 passes through branch 22 to pump 12. The closed position of valve 32 prevents fluid flow across branch 24. Discharge from pump 12 flows through discharge piping 26 to crossover piping 30. The closed position of valve 34 prevents fluid flow through discharge piping 26 beyond junction 42, while the open position of valve 36 permits fluid flow through crossover piping 30. Crossover piping 30 feeds in branch 24 downstream of valve 32 and feeds fluid into pump 14. Discharge from pump 14 flows through discharge piping 28 to outlet 20.

As shown in FIG. 1, dual pump system 10 may be mounted on a single skid 50. Skid 50 may be formed, for example, from steel or another high strength material. Pipes for piping inlet 18, outlet 20, branches 22 and 24, discharge piping 26, discharge piping 28, and crossover piping 30 may generally be made from steel or another material with high tensile strength and corrosion-resistance.

In operation, dual pump system 10 may automatically switch between parallel operation of pumps 12 and 14 to provide high flow and series operation of pumps 12 and 14 to provide high pressure. During initial operation periods, filter screens are relatively free of solids, allowing for higher flow rates at relatively low pressures. Optimal efficiencies can be achieved with pumps 12 and 14 operating in parallel. As the filters capture more solids and restrict fluid flow, higher pressures are required to pass fluids through the filter. Dual pump system 10 can switch to operate pumps 12 and 14 in series to achieve the required higher pressures. In one implementation, a programmable logic controller (PLC) or another control device may be used to automatically change the configuration of dual pump system 10 from parallel operation to series operation (and vice versa) based on user input values which may be determined through experimentation. For example, the PLC may be programmed to automatically switch dual pump system 10 from parallel to series flow after a particular time period for a specific installation site. In another implementation, sensors (e.g. pressure transducers) may also be used to provide feedback from the system to the PLC to trigger a change from parallel to series flow.

Figure 3:
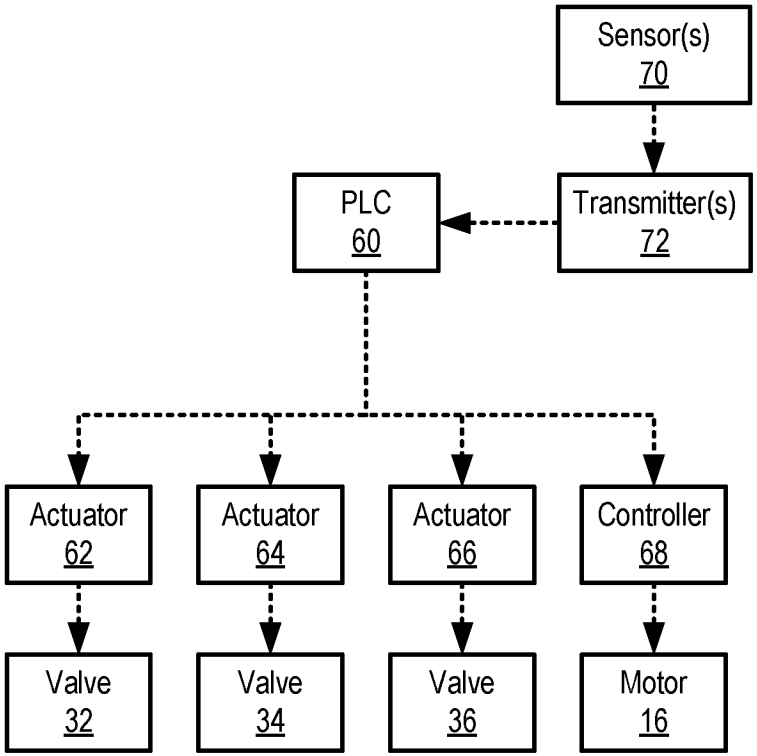
FIG. 3 is a schematic of an exemplary control system for the dual pump system of FIG. 1.

FIG. 3 provides a schematic of a control system for dual pump system 10. One or more programmable logic controllers (PLC) 60 may be connected to valve actuators 62, 64 and 66 and motor controller 68. Each of valve actuators 62, 64, and 66 may be configured to selectively move respective valves 32, 34 and 36 between an open position and a closed position. Controller 68 may provide variable speed controls for motor 16. As further shown in FIG. 3, dual pump system 10 may optionally include transmitters 72 for one or more sensors 70 connected to PLC 60. According to implementations described herein, communications among PLC 60, motor 16, actuators 62, 64 and 66, controller 68, and, optionally, transmitters 72 may be conducted using wired or wireless communications.

PLC 60 may control the position of valves 32, 34 and 36 (via valve actuators 62, 64, and 66) and speed of pumps 12 and 14 (via controller 68). In one implementation, PLC 60 settings for when to change valve positions and adjust pump speeds may be experimentally determined for each dual pump system 10 after on-site installation. Under normal startup conditions for dual pump system 10, PLC 60 may default to a parallel flow configuration, with valves 32 and 34 in an open position and valve 36 in a closed position. Based on experimental pressure readings (e.g., obtained from sensors 70 or other gauges) during installation tests, PLC 60 may be programmed to switch dual pump system 10 from parallel flow to series flow after a particular time interval (a time period after start-up). Thus, PLC 60 may be programmed to signal actuators 62, 64, and 66 to change to a series flow configuration with valves 32 and 34 in a closed position and valve 36 in an open position.

Sensors 70 may include one or more sensors, including, for example, suction pressure gauges and discharge pressure gauges. In one implementation, sensors 70 may be used to provide pressure readings during installation testing for experimentally determining changeover times for programming PLC 60. In another implementation, a suction pressure sensor may be included upstream of inlet 18, in dual pump system 10 and downstream pressure sensor may be included downstream of outlet 20 dual pump system 10. Thus, in some cases, sensors 70 may not be included with or co-located on skid 50. In other implementations, sensors 70 may include one or more flow meters.

In another embodiment, transmitters 72 may collect data from sensors 70 (such as a suction pressure sensor, a discharge pressure sensor, and/or a flow meter) to provide a closed loop feedback system. For example, actuators 62, 64, 66 may provide a position (e.g., open/closed) feedback signal. Additionally, controller 68 may provide a speed (e.g., revolutions per minute) feedback signal. Signals from actuators 62, 64, 66, controller 68, and transmitters 72 may be sent to PLC 60. PLC 60 may analyze signals from sensors 70 and calculate a closed loop response to determine, for example, valve positions for valves 32, 34, and 36 to configure dual pump system 10 in parallel or series. PLC 60 may also adjust speeds for motor 16 based on signals from sensors 70. In one implementation, PLC 60 may automatically adjust the position of valves 32, 34, and 36, via the respective actuators 62, 64, and 66, based on threshold discharge pressure readings entered by a user.

In a closed loop operation, PLC 60 may start in a parallel flow configuration with valves 32 and 34 in an open position and valve 36 in a closed position. After startup, sensors 70 (via transmitters 72) may provide feedback, such as discharge pressures, to PLC 60. Upon detecting a high pressure threshold (e.g., a discharge pressure level selected by an operator), PLC 60 may signal actuators 62, 64, and 66 to change to a series configuration with valves 32 and 34 in a closed position and valve 36 in an open position. In one implementation, PLC 60 may employ two or more pressure thresholds to prevent vacillating between parallel and series configurations for dual pump system 10. For example, based on a single discharge pressure setting (e.g., as set by a user or a default threshold setting), PLC 60 may identify a low threshold (e.g., 5% below the single setting) and a high threshold (e.g. 5% above the single setting) with a hysteresis region in between the two thresholds to prevent system cycling. In another implementation, PLC 60 may be configured to require multiple consecutive high pressure readings, for example, before initiating a configuration change from parallel to series flow.

Figure 4:
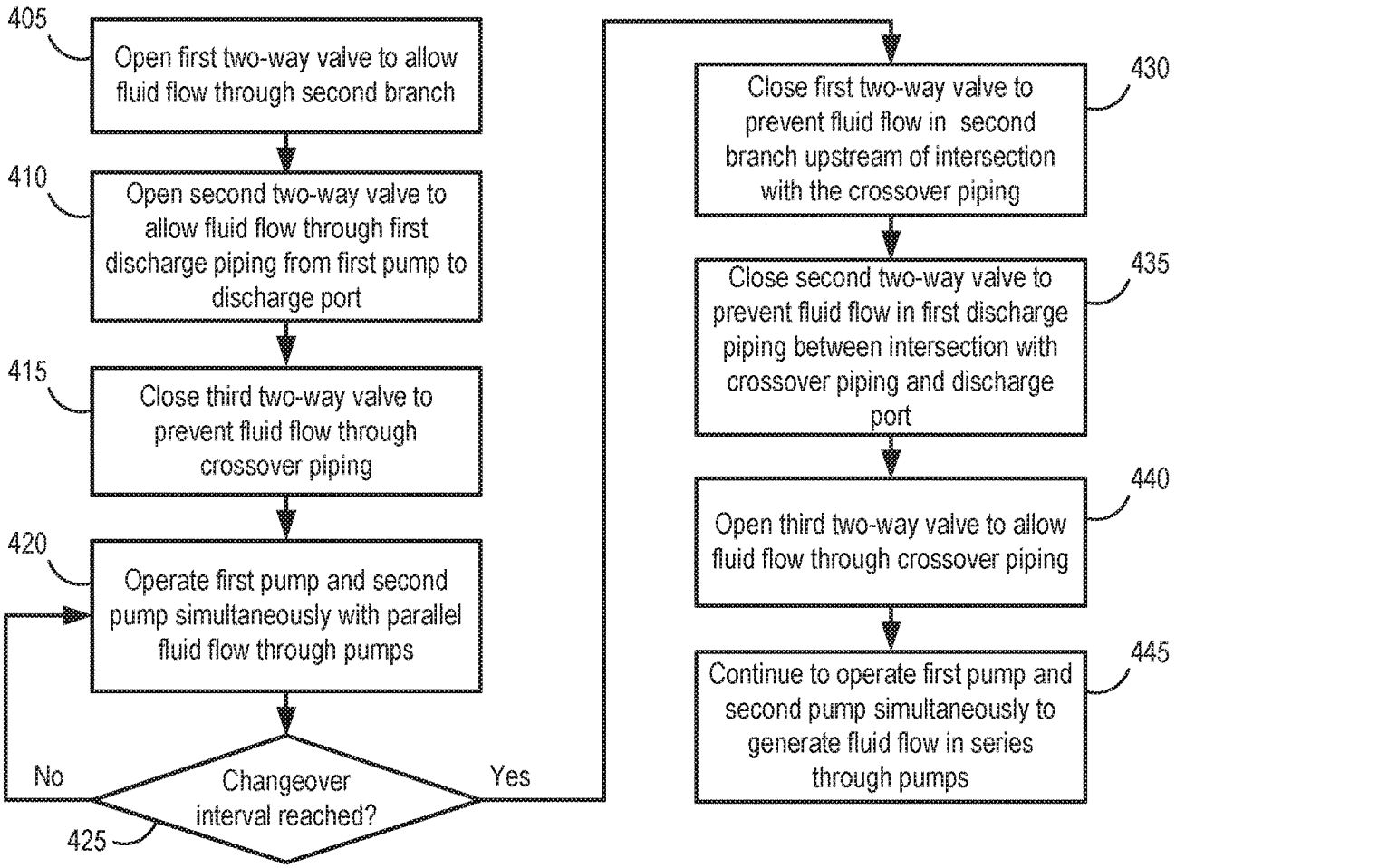
FIG. 4 is a flow diagram of an exemplary process for operating the dual pump system of FIG. 1.

FIG. 4 is a flow diagram of an exemplary process 400 for operating dual pump system 10. As shown in FIG. 4, process 400 may include opening a first two-way valve to allow fluid flow through the second branch (block 405), opening a second two-way valve to allow fluid flow through the first discharge piping from the first centrifugal pump to the discharge port (block 410), and closing a third two-way valve to prevent fluid flow through the crossover piping (block 415). For example, in one implementation, valves 32 and 34 may be set to an open position, and valve 36 may be set to a closed position, by PLC 60 as part of a startup sequence for dual pump system 10.

Process 400 may further include operating the first centrifugal pump and the second centrifugal pump simultaneously to generate parallel fluid flow through the first centrifugal pump and the second centrifugal pump (block 420) and determining if a changeover interval has occurred (block 425). For example, PLC 60 may cause motor 16 to ramp up to steady state operation for pumps 12 and 14 working in parallel. PLC 60 may be programmed with a changeover time interval (e.g., a time period determined from installation testing) to initiate a change from parallel to series operation.

If the changeover interval has not occurred (block 425—No), process 400 may continue to operate the pumps in parallel (block 420). If the changeover interval has occurred (block 425—Yes), process 400 may include closing the first two-way valve to prevent fluid flow in the second branch upstream of an intersection with the crossover piping (block 430), closing the second two-way valve to prevent fluid flow in the first discharge piping between an intersection with the crossover piping and the discharge port (block 435), and opening the third two-way valve to allow fluid flow through the crossover piping (block 440). For example, PLC 60 may clock a time interval from start-up of dual pump system 10. While the time interval remains below a programmed changeover time limit, PLC 60 may maintain dual pump system 10 in a parallel configuration. When the changeover time limit is reached, PLC 60 may send signals to actuators 62, 64, and 66 to switch the orientation of respective valves 32, 34, and 36, effectively changing the piping configuration of dual pump system 10 to operate pumps 12 and 14 in series. In one implementation, PLC 60 may adjust the speed of motor 16 during and/or after the valve position changes. Dual pump system 10 may remain in operation during the changeover from parallel to series configuration. Thus, in one implementation, valves 32, 34, and 36 may change position simultaneously (e.g., no sequencing is required).

Process 400 may also include continuing to operate the first pump and the second pump simultaneously to generate fluid flow in series through the first pump and the second pump (block 445). In one implementation, PLC 60 may continue to monitor discharge pressures. For example, if PLC 60 detects consistent reduce discharge pressures (e.g., below the programmed threshold), PLC 60 may reconfigure dual pump system 10 to a parallel flow configuration. In another implementation, PLC 60 may not automatically return to dual pump system 10 to a parallel flow configuration, regardless of reported changes in discharge pressure.

Figure 5:
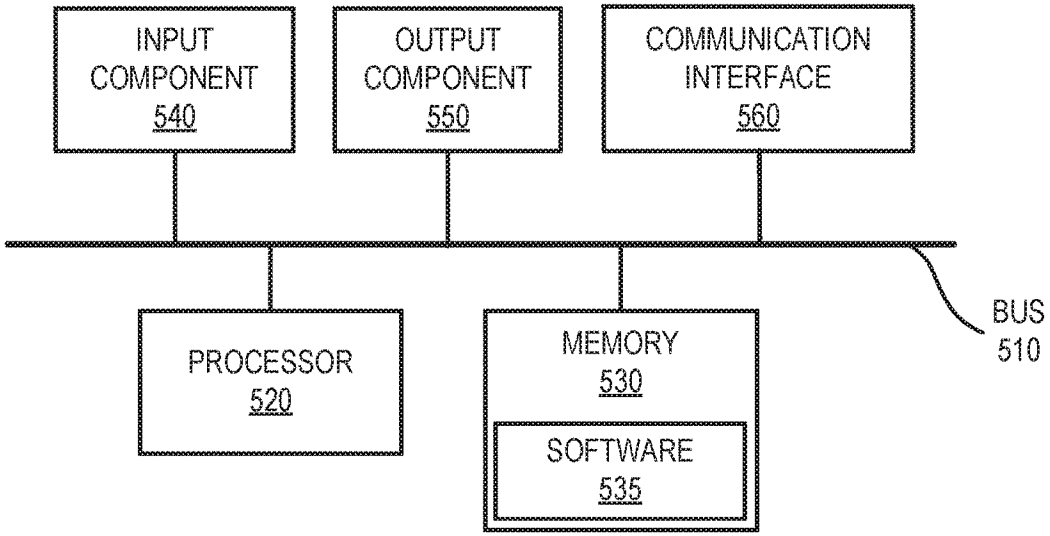
FIG. 5 is a diagram illustrating exemplary components of a device that may correspond to the programmable logic controller (PLC) of FIG. 3.

FIG. 5 is a diagram illustrating exemplary components of a device 500. Device 500 may correspond, for example, to PLC 60. Device 500 may include a bus 510, a processor 520, a memory 530 with software 535, an input component 540, an output component 550, and a communication interface 560.

Bus 510 may include a path that permits communication among the components of device 500. Processor 520 may include a processor, a microprocessor, or processing logic that may interpret and execute instructions. Memory 530 may include any type of dynamic storage device that may store information and instructions, for execution by processor 520, and/or any type of non-volatile storage device that may store information for use by processor 520.

Software 535 includes an application or a program that provides a function and/or a process. Software 535 may also include firmware, middleware, microcode, hardware description language (HDL), and/or other form of instruction. Input component 540 may include a mechanism that permits a user to input information to device 500, such as a keyboard, a keypad, a button, a switch, etc. Output component 550 may include a mechanism that outputs information to the user, such as a display, a speaker, one or more light emitting diodes (LEDs), etc.

Communication interface 560 may include a transceiver that enables device 500 to communicate with other devices and/or systems via wireless communications, wired communications, or a combination of wireless and wired communications. For example, communication interface 560 may include mechanisms for communicating with another device or system via a network. Communication interface 560 may include an antenna assembly for transmission and/or reception of radio frequency (RF) signals. Alternatively or additionally, communication interface 560 may be a logical component that includes input and output ports, input and output systems, and/or other input and output components that facilitate the transmission of data to other devices.

Device 500 may perform certain operations in response to processor 520 executing software instructions (e.g., software 535) contained in a computer-readable medium, such as memory 530. A computer-readable medium may be defined as a non-transitory memory device. A memory device may be implemented within a single physical memory device or spread across multiple physical memory devices. The software instructions may be read into memory 530 from another computer-readable medium or from another device. The software instructions contained in memory 530 may cause processor 520 to perform processes described herein. Alternatively, hardwired circuitry may be used in place of or in combination with software instructions to implement processes described herein. Thus, implementations described herein are not limited to any specific combination of hardware circuitry and software.

As set forth in this description and illustrated by the drawings, reference is made to "an exemplary embodiment," "an embodiment," "embodiments," etc., which may include a particular feature, structure or characteristic in connection with an embodiment(s). However, the use of the phrase or term "an embodiment," "embodiments," etc., in various places in the specification does not necessarily refer to all embodiments described, nor does it necessarily refer to the same embodiment, nor are separate or alternative embodiments necessarily mutually exclusive of other embodiment(s). The same applies to the term "implementation," "implementations," etc.

The foregoing description of embodiments provides illustration, but is not intended to be exhaustive or to limit the embodiments to the precise form disclosed. Accordingly, modifications to the embodiments described herein may be possible. For example, various modifications and changes may be made thereto, and additional embodiments may be implemented, without departing from the broader scope of the invention as set forth in the claims that follow. The description and drawings are accordingly to be regarded as illustrative rather than restrictive.

The terms "a," "an," and "the" are intended to be interpreted to include one or more items. Further, the phrase "based on" is intended to be interpreted as "based, at least in part, on," unless explicitly stated otherwise. The term "and/or" is intended to be interpreted to include any and all combinations of one or more of the associated items. The word "exemplary" is used herein to mean "serving as an example." Any embodiment or implementation described as "exemplary" is not necessarily to be construed as preferred or advantageous over other embodiments or implementations.

Use of ordinal terms such as "first," "second," "third," etc., in the claims to modify a claim element does not by itself connote any priority, precedence, or order of one claim element over another, the temporal order in which acts of a method are performed, the temporal order in which instructions executed by a device are performed, etc., but are used merely as labels to distinguish one claim element having a certain name from another element having a same name (but for use of the ordinal term) to distinguish the claim elements.

No element, act, or instruction used in the description of the present application should be construed as critical or essential to the invention unless explicitly described as such.

What is claimed is:

1. A dual pump system for filter feed applications, the dual pump system comprising:

a first pump;

a second pump, wherein the first and second pumps are centrifugal pumps rated for use with slurry having a solids diameter of up to 0.5 inches;

a motor simultaneously driving the first and second pumps;

suction piping with a first branch leading to the first pump and a second branch leading to the second pump;

first discharge piping connecting the first pump to a discharge port directed toward a filter screen to capture the solids;

second discharge piping connecting the second pump to the discharge port;

crossover piping connecting the first discharge piping to the second branch;

a first two-way valve installed in the second branch;

a second two-way valve installed in the first discharge piping and downstream of the crossover piping;

a third two-way valve installed in the crossover piping, wherein each of the first, second, and third two-way valves further comprises an actuator that controls a valve position as open or closed, wherein the first pump and the second pump operate in a parallel configuration to provide relatively higher discharge flow rates when the first and second two-way valves are opened and the third two-way valve is closed, and wherein the first pump and the second pump operate in a series configuration to provide relatively higher discharge pressure when the first and second two-way valves are closed and the third two-way valve is opened; and a programmable logic controller (PLC) configured to automatically change, via the respective actuators, the position of the first, second, and third two-way valves from the parallel configuration at start-up to the series configuration after a particular time period based on user input for a specific installation site.

2. The dual pump system of claim 1, wherein the dual pump system, including the first and second pumps; the suction piping; the first and second discharge piping; the first, second, and third two-way valves; and the actuators, is mounted on a single skid.

3. The dual pump system of claim 1, wherein the first and second pumps have identical operating levels to each other during any stage of operation.

4. The dual pump system of claim 1, wherein the first and second pumps each have a maximum flow operating level of 520 gallons-per-minute.

5. The dual pump system of claim 1, wherein first and second branches have three-inch diameter piping and wherein the first and second discharge piping has a two-inch diameter.

6. The dual pump system of claim 1, wherein the crossover piping connects to the second branch at a location downstream of the first two-way valve.

7. The dual pump system of claim 1, wherein the suction piping is connected to a single inlet.

8. A method performed by a dual pump system that includes a first pump, a second pump, a motor simultaneously driving the first and second pumps, suction piping with a first branch leading to the first pump and a second branch leading to the second pump, first discharge piping connecting the first pump to a discharge port directed toward a filter screen to capture the solids, second discharge piping connecting the second pump to the discharge port, crossover piping connecting the first discharge piping to the second branch, and a programmable logic controller (PLC) configured to automatically change the position of the first, second, and third two-way valves, the method comprising:

opening a first two-way valve installed in the second branch to allow fluid flow through the second branch;

opening a second two-way valve installed in the first discharge piping and downstream of the crossover piping to allow fluid flow through the first discharge piping from the first pump to the discharge port;

closing a third two-way valve installed in the crossover piping to prevent fluid flow through the crossover piping;

starting operating the first pump and the second pump simultaneously to generate parallel fluid flow through the first pump and the second pump;

detecting completion of a preset time interval based on user input for a specific installation site;

closing, in response to the detecting, the first two-way valve to prevent fluid flow in the second branch upstream of an intersection with the crossover piping;

closing, in response to the detecting, the second two-way valve to prevent fluid flow in the first discharge piping between another intersection with the crossover piping and the discharge port;

opening, in response to the detecting, the third two-way valve to allow fluid flow through the crossover piping; and continuing, after the detecting, to operate the first pump and the second pump simultaneously, wherein the dual pump system generates additional fluid pressure in series through the dual pump system toward the filter screen.

* * * * *